US007806610B2

(12) United States Patent
Nelson et al.

(10) Patent No.: US 7,806,610 B2
(45) Date of Patent: Oct. 5, 2010

(54) PRINTER WITH COVER HAVING LATERALLY MOVABLE HINGE

(75) Inventors: Eric Nelson, Waterloo, NE (US); James Price, Alpharetta, GA (US); Hugh McCormack, Winder, GA (US); Carl Robinson, Charlotte, NC (US)

(73) Assignee: First Data Corporation, Greenwood Village, CO (US)

( * ) Notice: Subject to any disclaimer, the term of this patent is extended or adjusted under 35 U.S.C. 154(b) by 564 days.

(21) Appl. No.: 11/749,287

(22) Filed: May 16, 2007

(65) Prior Publication Data

US 2007/0269250 A1 Nov. 22, 2007

Related U.S. Application Data

(60) Provisional application No. 60/747,362, filed on May 16, 2006.

(51) Int. Cl.
*B41J 29/13* (2006.01)
*B41J 29/00* (2006.01)

(52) U.S. Cl. ..... 400/693; 400/613; 347/222

(58) Field of Classification Search ..... 400/693; 347/222

See application file for complete search history.

(56) References Cited

U.S. PATENT DOCUMENTS 4,236,274 A * 12/1980 Omote et al. ..... 16/225
5,201,588 A * 4/1993 Sakai et al. ..... 400/613
6,373,511 B1 4/2002 Groves et al.
6,447,187 B1 * 9/2002 Robinson ..... 400/621
6,666,604 B1 12/2003 Montagutelli
6,802,603 B1 10/2004 Montagutelli
2004/0119808 A1 6/2004 Mori
2007/0172289 A1 * 7/2007 Robinson ..... 400/613

FOREIGN PATENT DOCUMENTS

JP 08-072910 A 3/1996
JP 2001301270 A * 10/2001
JP 2002-036666 A 2/2002
JP 2004-196498 A 7/2004
JP 2004196498 A * 7/2004

OTHER PUBLICATIONS

Definition of "integral," from Free Dictionary Online, http://www.thefreedictionary.com/integral, printed Feb. 5, 2010.*

* cited by examiner

*Primary Examiner*—Daniel J Colilla
(74) *Attorney, Agent, or Firm*—Townsend and Townsend and Crew, LLP

(57) ABSTRACT

A printer with a chassis, a hinge and a paper cover assembly. The chassis may have a printing head and a notch. The hinge may have an axis, and may be coupled with the chassis such that the rotational axis of the hinge is laterally movable. The paper cover assembly may be coupled with the hinge, and may be rotatable about the hinge. The paper cover assembly may have a roller and a handle. The roller may have an axis, and when the paper cover assembly is closed, the axis of the roller may be within the notch. The handle may be configured to move a cam mechanism, and when the paper cover assembly is closed and the mechanism is moved, the mechanism may act against the chassis causing the axis of the hinge to laterally move, thereby causing the axis of the roller to move out of the notch.

13 Claims, 7 Drawing Sheets

100

120

700

PRINTER WITH COVER HAVING LATERALLY MOVABLE HINGE

PRIORITY CLAIM

This application claims priority to Provisional U.S. Patent Application No. 60/747,362 filed May 16, 2006, entitled "PRINTING APPARATUS," the entire disclosure of which is hereby incorporated by reference as if fully set forth herein.

BACKGROUND

The present invention pertains generally to printers and more specifically to paper cover mechanisms for printers, especially thermal printers. In many types of printers, the printer may have a storage compartment for a source of paper or other printable medium. These printers often conceal and protect the paper source with a paper cover to prevent interference by the user or others with the feeding of paper into the printing mechanism, which may cause failure of the printer.

In some printer types there also exists a need to integrate another component of the printing mechanism with the paper cover. In thermal printers, a roller is often integrated with the paper cover. When the paper cover is closed the roller assists other parts of the printing mechanism to produce text and images on the paper. To print, the roller may need to be in a substantially stationary position with respect to other parts of the printer. If the roller must be stationary when the paper cover is in the closed position, while also being firmly attached to the paper cover, the paper cover may be resistive to opening.

Solutions have been proposed for easily opening paper covers that are resistive to opening because of these rollers. U.S. Pat. No. 6,802,603, entitled "DEVICE FOR UNLOCKING A COMPARTMENT OF AN OPENING MECHANISM," issued on Oct. 12, 2004 to Denis Montagutelli discloses a lever comprising stop elements capable of co-operating with the sides of a frame to cause a cover to rotate relative to the frame when a user rotates the lever. U.S. Pat. No. 6,666,604, entitled "THERMAL PRINTING DEVICE WITH FAST CLOSURE," issued on Dec. 23, 2003 to Denis Montagutelli discloses a printer with a roller that has two degrees of freedom relative to the cover that may allow a cover to open. These proposed solutions require either additional parts on the paper cover assembly or overly complicated movement of parts which must be critically located with respect to associated printing mechanisms. Embodiments of the present invention provide solutions to these and other issues.

BRIEF DESCRIPTION OF THE INVENTION

In one embodiment a printer is provided which has a chassis, a hinge and a paper cover assembly. The chassis may include a printing head and at least one notch. The chassis may substantially be made from Acrylonitrile Butadiene Styrene ("ABS").

The hinge may have a rotational axis, and also may be coupled with the chassis such that the rotational axis of the hinge may be laterally movable with respect to the chassis. The hinge may be coupled with an intermediate member flexibly coupled with the chassis in some embodiments. Also in some embodiments, the hinge may be coupled with a secondary hinge, and the secondary hinge may be coupled with the chassis. The hinge may be rotationally movable around some fixed point on the chassis.

The paper cover assembly may be coupled with the hinge, and be rotatable about the rotational axis of the hinge. The paper cover assembly may have a roller and a handle. The roller may have a rotational axis, and when the paper cover assembly is closed, the rotational axis of the roller may be within the at least one notch. The rotational axis of the roller may be substantially stationary with respect to the paper cover assembly. The handle may be configured to move a cam mechanism. When the paper cover assembly is closed and the cam mechanism is moved, the cam mechanism may act against the chassis causing the rotational axis of the hinge to laterally move with respect to the chassis. The rotational axis of the roller may move out of the notch because of the lateral movement of the rotational axis of the hinge. The handle may include a raised portion configured to allow a user to pull the handle with a finger.

The paper cover assembly may include a spring configured to bias the position of the handle. In the biased position, the cam mechanism may not act against the chassis when the paper cover assembly is closed. The cam mechanism may include a shaft and at least one cam head. The handle may be coupled to the shaft and the shaft may be coupled with the cam head. In some embodiments the handle may be configured to move the shaft, thus moving the cam head. The cam head may substantially be made from Polyoxymethylene.

The hinge may be configured such that applying a lateral force to the hinge when the paper cover assembly is closed moves the rotational axis of the hinge laterally with respect to the chassis. The lateral movement of the hinge may cause the rotational axis of the roller to move out of the notch. Some embodiments may also include a spring which may be configured to bias the position of the printing head. In the biased position, the printing head may resist movement of the rotational axis of the roller into or out of the notch.

In other embodiments a printer having a chassis, a hinge and a paper cover is provided. The chassis may have a printing head and at least one notch. The hinge may have a rotational axis, and may be coupled with the chassis such that the rotational axis of the hinge is laterally movable with respect to the chassis. In some embodiments, the hinge may be coupled with a secondary hinge, and the secondary hinge may be coupled with the chassis.

The paper cover may be coupled with the hinge, and may be rotatable about the rotational axis of the hinge. In some embodiments, the hinge may be coupled with an intermediate member flexibly coupled with the chassis. The hinge may be configured such that applying a lateral force to the hinge when the paper cover is closed moves the rotational axis of the hinge laterally with respect to the chassis. This lateral movement of the hinge may cause the paper cover to open. In some embodiments, a spring may also be provided. The spring may be configured to bias the position of the printing head. In the biased position, the printing head may resist movement of the paper cover into or out of a closed position.

In yet other embodiments a printing system may be provided having: a means for holding a source of paper; a means for covering the source of paper; a means for rotating the means for covering the source of paper relative to the means for holding the roll of paper; and a means for allowing the rotational axis to laterally move. The means for rotating the means for covering the source of paper relative to the means for holding the roll of paper may have a rotational axis. When the rotational axis laterally moves, the means for covering the source of paper may be at least partially opened. The printing system may also have a means for moving the rotational axis. The means for moving the rotational axis may be a handle configured to move a cam mechanism. When the means for covering the source of paper is closed and the cam mechanism is moved, the cam mechanism acts against the means for holding the source of paper. The cam mechanism acting against the means for holding the source of paper may cause the rotational axis to move laterally with respect to the means for holding the source of paper, thereby at least partially opening the means for covering the source of paper.

BRIEF DESCRIPTION OF THE DRAWINGS

The present disclosure is described in conjunction with the appended figures.

Figure 1:
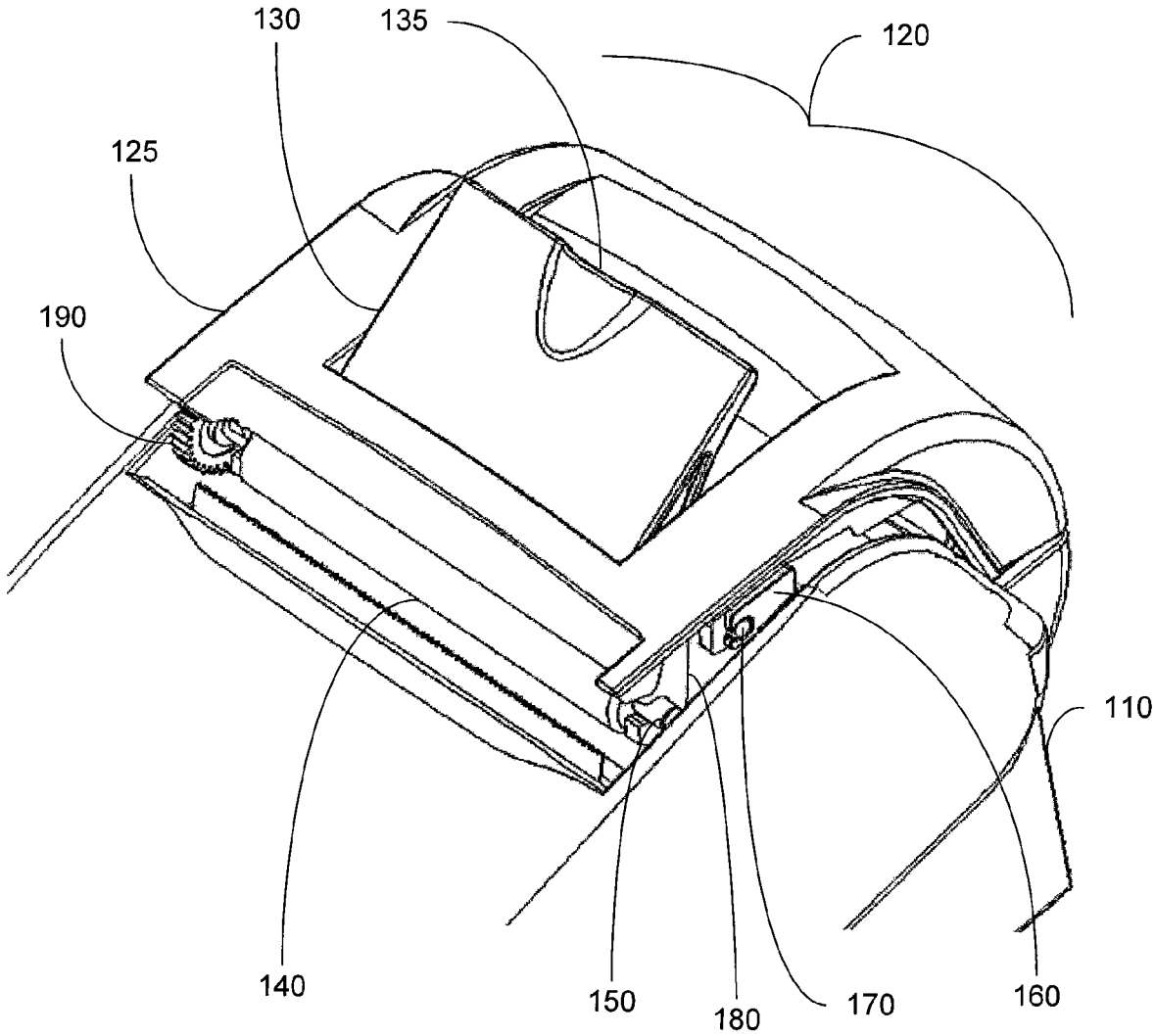
FIG. 1 is a partial isometric view of one embodiment of the present invention having a chassis, a hinge, and a paper cover assembly with a handle and cam mechanism.

In the appended figures, similar components and/or features may have the same reference label. Further, various components and/or features of the same type may be distinguished by following the reference label by a letter that distinguishes among the similar components and/or features. If only the first reference label is used in the specification, the description is applicable to any one of the similar components and/or features having the same first reference label irrespective of the letter suffix.

DETAILED DESCRIPTION OF THE INVENTION

In one embodiment a printer is provided which has a chassis, a hinge and a paper cover assembly. The printer may be a thermal printer, a toner-based printer, a Light Emitting Diode ("LED") printer, a laser printer, an ink-jet printer, an impact printer, a dot-matrix printer, a ballistic wire printer, a stored energy printer, a line printer, a drum printer, or a chain printer. In some embodiments, the printer may be integral with another piece of equipment such as a point-of-sale device such as a computer or register, possibly with a bar code reader; a credit card, debit card, or Automated Teller Machine ("ATM") card reader; a computer; or other system that contains an electronic processor.

The chassis of the printer may include a printing head and at least one notch. The printing head may be any type of device used to make text and/or images appear on paper by the types of printers described above or other printers. In exemplary embodiments, the printing head may be a thermal print head. Many typical thermal printing heads are commercially available, for instance, from Kyocera Corp. under the KPB, KCE, KPC, KHT, and KYT product lines, among others. The chassis may substantially be made from Acrylonitrile Butadiene Styrene ("ABS") or other types of plastics, polymers or composites. The chassis may be made up of multiple components, with some of the components possible being made substantially from metal or other materials.

The hinge of the printer may have a rotational axis. The hinge may be coupled with the chassis such that the rotational axis of the hinge may be laterally movable with respect to the chassis. The hinge may be composed of multiple pieces in some embodiments, and may possibly consist of portions of the paper cover assembly and the chassis. For example, protruding portions of the paper cover assembly and/or the chassis could mate and interact to form a hinge. In other embodiments, a distinct hinge component composed of one or more sub-components may be coupled with both the paper cover assembly and chassis.

The hinge may be coupled with an intermediate member flexibly coupled with the chassis in some embodiments. The flexible coupled intermediate member may be what allows the rotational axis of the hinge to be laterally movable with respect to the chassis. In some embodiments the intermediate member may be integral with the chassis. For example, a portion of a chassis made from plastic may be only minimally structurally integrated with the remainder of the chassis, thereby being flexible with respect to the remainder of the chassis. This portion of the chassis may constitute the intermediate member in some embodiments.

In some embodiments, the hinge may be coupled with a secondary hinge, and the secondary hinge may be coupled with the chassis. In these configurations, the hinge may be rotationally movable around some fixed point on the chassis due to the secondary hinge being fixedly coupled with the chassis. An intermediate member may be coupled between the two hinges in some embodiments.

The paper cover assembly may be coupled with the hinge, and be rotatable about the rotational axis of the hinge. The paper cover assembly may have a roller, a handle and possibly other components. In some embodiments the roller may be a platen shaft, the platen shaft being part of a thermal printing mechanism. In these embodiments, the roller may apply pressure to thermal printing paper between the shaft and a thermal print head. The thermal print head may then apply heat to, and thereby leave print on, the thermal printing paper. The roller may have a rotational axis, and when the paper cover assembly is closed, the rotational axis of the roller may be within the notch. The notch in the chassis may be sized to match the outer diameter of a shaft the roller is attached to. In some embodiments, the rotational axis of the roller may be substantially stationary with respect to the paper cover assembly. In other embodiments, the roller may have some freedom of movement with respect to the paper cover assembly. The handle may be configured to move a cam mechanism, wherein when the paper cover assembly is closed and the cam mechanism is moved, the cam mechanism acts against the chassis causing the rotational axis of the hinge to laterally move with respect to the chassis. This movement may cause the rotational axis of the roller to move out of the notch. The handle may include a raised portion configured to allow a user to pull the handle with a finger. The cam mechanism may convert a rotational force exerted by the user of the handle into a linear motion which acts against the chassis.

The paper cover assembly may include a spring configured to bias the position of the handle such that in the biased position the cam mechanism does not act against the chassis when the paper cover assembly is closed. The spring may be of various configurations known in the art to bias a mechanical element towards a given position, including a formed or shaped spring. In some embodiments, the cam mechanism may include a shaft and at least one cam head. The handle may be coupled to the shaft, and the shaft may be coupled with the cam head. The handle may be configured to rotate, causing the shaft to move in a slot shaped cavity defined by a structural or other component of the paper cover assembly. The shaft may move along the length of the slot, thereby causing the cam head to move in a linear manner and act against the chassis. The cam head may substantially be made from Polyoxymethylene or other types of plastics, polymers or composites. Exemplarily embodiments may employ complimentary types of materials for the chassis and the cam heads such that wear is reduced between the two parts.

In some embodiments, the hinge may be configured such that applying a lateral force to the hinge when the paper cover assembly is closed moves the rotational axis of the hinge laterally with respect to the chassis. The movement of the rotational axis of the hinge may cause the rotational axis of the roller to move out of the notch. In these embodiments, a user may push on the hinge, therefore causing the shaft on the paper cover assembly to move out the notch in the chassis. In these embodiments, the paper cover assembly may not include the handle and cam mechanism. Some embodiments may also include a spring which may be configured to bias the position of the printing head. In the biased position the printing head may resist movement of the rotational axis of the roller into or out of the notch. The spring may be a flat trapezoid spring or some other spring known in the art for biasing a mechanical element towards a given position.

In embodiments containing a spring configured to bias the position of the printing head, the printing head may be biased in a direction passing above the rotational axis of the hinge. In these embodiments, the biased position of the print head may resist movement of the rotational axis of the roller both into, and out of, the notch. When the rotational axis of the roller faces resistance into, and out of, the notch, the paper cover assembly may resist being opened when closed, and resist being closed when open. When the paper cover assembly is open, and the rotational axis of the roller is not in the notch, the biasing force of the spring may be overcome by the user pressing down on the paper cover assembly. The force applied by the user may cause the rotational axis of the hinge to move, overcoming the biasing force of the spring, allowing the rotational axis of the roller to enter the notch and thereby closing the paper cover assembly. When the paper cover assembly is closed, the process may work in reverse. When the user applies a force to the hinge in a lateral direction, or pulls on the handle and causing the cam mechanism to act against the chassis, the rotational axis of the hinge may be moved. This movement may overcome the biasing force of the spring, allowing the rotational axis of the roller to exit the notch, thereby opening the paper cover assembly.

In other embodiments a printer having a chassis, a hinge and a paper cover is provided. The chassis may have a printing head and at least one notch. The hinge may have a rotational axis, and may be coupled with the chassis such that the rotational axis of the hinge is laterally movable with respect to the chassis. Also in some embodiments, the hinge may be coupled with a secondary hinge, and the secondary hinge may be coupled with the chassis.

The paper cover may be coupled with the hinge, and may be rotatable about the rotational axis of the hinge. In some embodiments, the hinge may be coupled with an intermediate member which is flexibly coupled with the chassis. The hinge may be configured such that applying a lateral force to the hinge when the paper cover is closed moves the rotational axis of the hinge laterally with respect to the chassis. This movement may cause the paper cover to open. In some embodiments, a spring, configured to bias the position of the printing head, may also be provided. In the biased position the printing head may resist movement of the paper cover into or out of a closed position.

In other embodiments, a printing system may be provided having: a means for holding a source of paper; a means for covering the source of paper; a means for rotating the means for covering the source of paper relative to the means for holding the roll of paper; and a means for allowing the rotational axis to laterally move. The means for rotating the means for covering the source of paper relative to the means for holding the roll of paper may have a rotational axis. When the rotational axis laterally moves, the means for covering the source of paper may be at least partially opened. The printing system may also have a means for moving the rotational axis. The means for moving the rotational axis may be a handle configured to move a cam mechanism. When the means for covering the source of paper is closed and the cam mechanism is moved, the cam mechanism may act against the means for holding the source of paper thereby causing the rotational axis to move laterally with respect to the means for holding the source of paper. This movement may at least partially open the means for covering the source of paper.

Turning now to FIG. 1, a partial isometric view of a printer 100 of the present invention is shown. In this embodiment, the printer 100 has a chassis 110, a hinge 210 (see FIG. 2), and a paper cover assembly 120. The paper cover assembly has a body 125, a handle 130 with a raised portion 135, and a roller 140 on a roller shaft 150. The paper cover assembly 120 also contains two cam heads 160 (only one is visible from this view) on a cam shaft 170. The paper cover assembly 125 also has two roller shaft arms 180 (only one is completely visible in FIG. 1) which hold the roller shaft 150. Additionally, the roller shaft 150 is shown having a drive gear 190 on one end that interacts with another portion of the printer mechanism contained in the chassis 110. The handle 130 is shown in the raised position, overcoming a biasing spring (not shown here, but seen in FIG. 3). In this position the handle 130 has moved the cam mechanism, which includes in this embodiment the cam heads 160 and the cam shaft 170. The movement of the handle 130 has moved the cam shaft 170 through slots in the body 125 to produce linear movement of the cam heads 160. The cam heads 160 have acted against the chassis 110 and therefore opened the paper cover assembly 120 to the degree shown in FIG. 1. The hinge 210 which connects the paper cover assembly 120 with the chassis 110 is not shown in FIG. 1, but will be shown in greater detail in FIG. 2 and FIG. 4.

Figure 2:
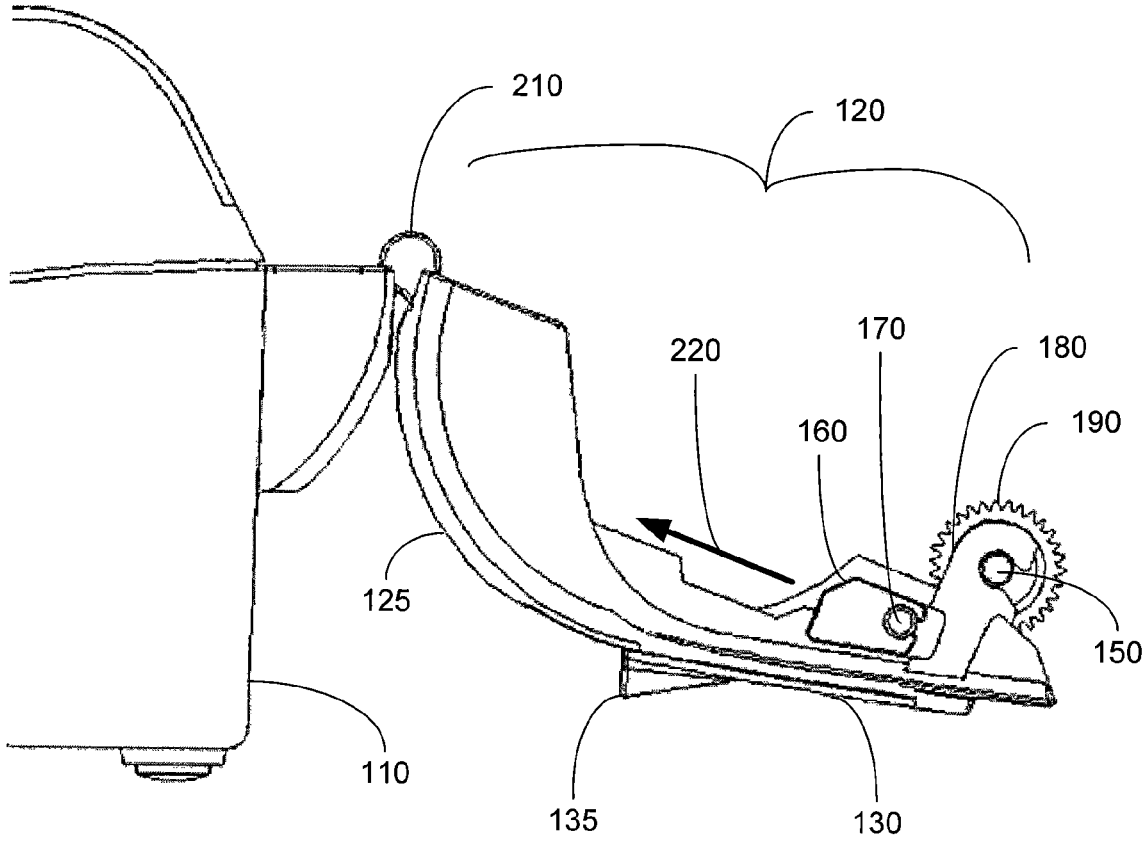
FIG. 2 is a partial side view of the embodiment shown in FIG. 1.
Figure 2:
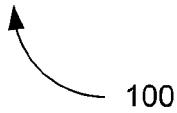
Figure 3:
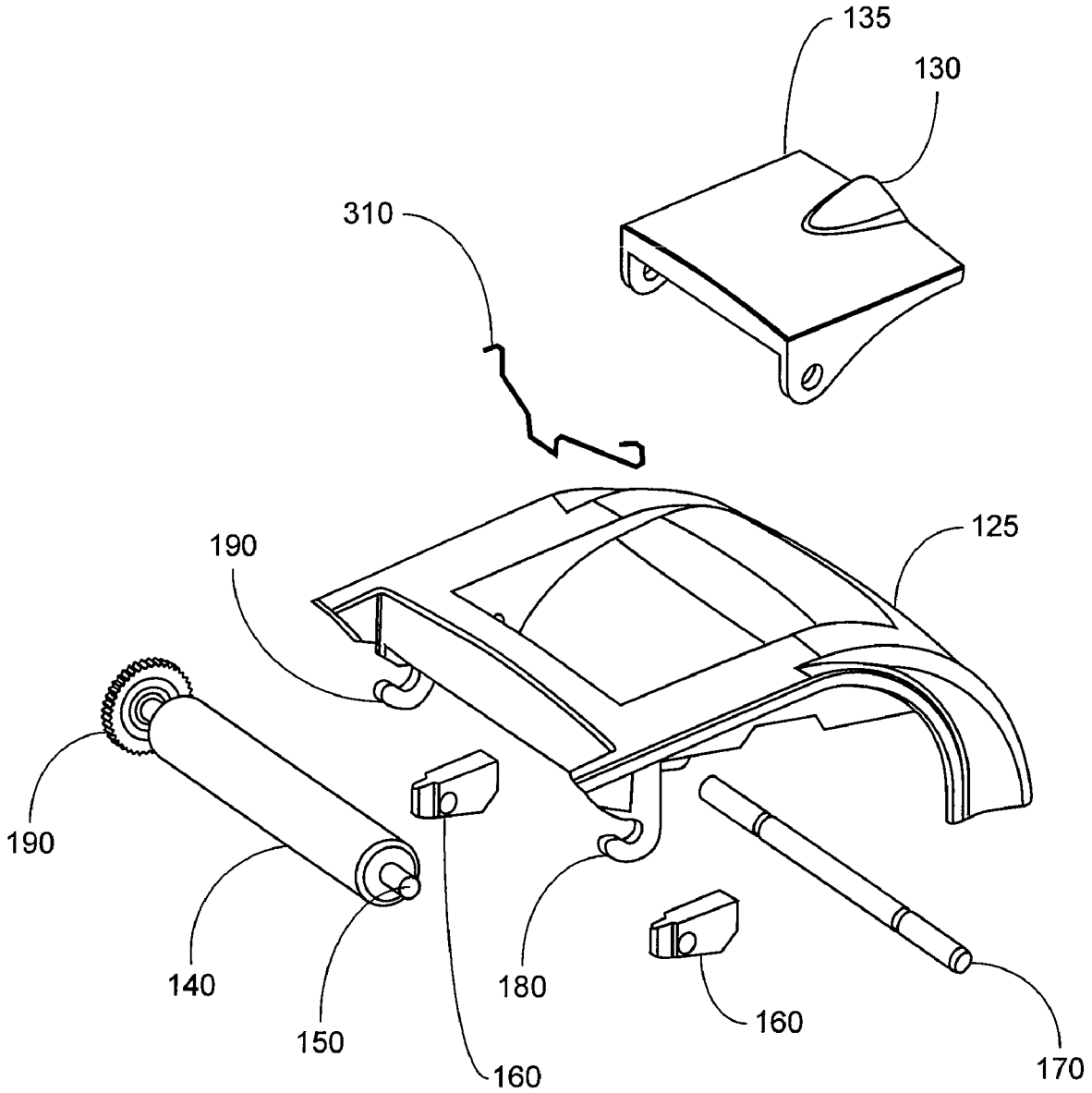
FIG. 3 is an exploded view of the paper cover assembly shown in FIG. 1.

In FIG. 2, a partial side view of the printer 100 from FIG. 1 is shown. Here the hinge 210 is shown which connects the paper cover assembly 120 to the chassis 110. Also shown in FIG. 2 is a motion arrow 220 which shows the direction that the cam heads 160 move when the handle 135 is rotated, thereby moving the cam shaft 170 along slots in the body 125. When the paper cover assembly 120 is closed, and the handle 135 rotated, the cam heads 160 will act against the chassis 110, thereby causing the hinge 210 to move laterally. The roller shaft 150 thereby moves out of notches in the chassis 110, opening the paper cover assembly 120. In FIG. 3, an exploded view of the paper cover assembly 120 is shown having substantially the same components as shown in FIG. 1. The biasing spring 310 is also shown in FIG. 3.

Figure 4:
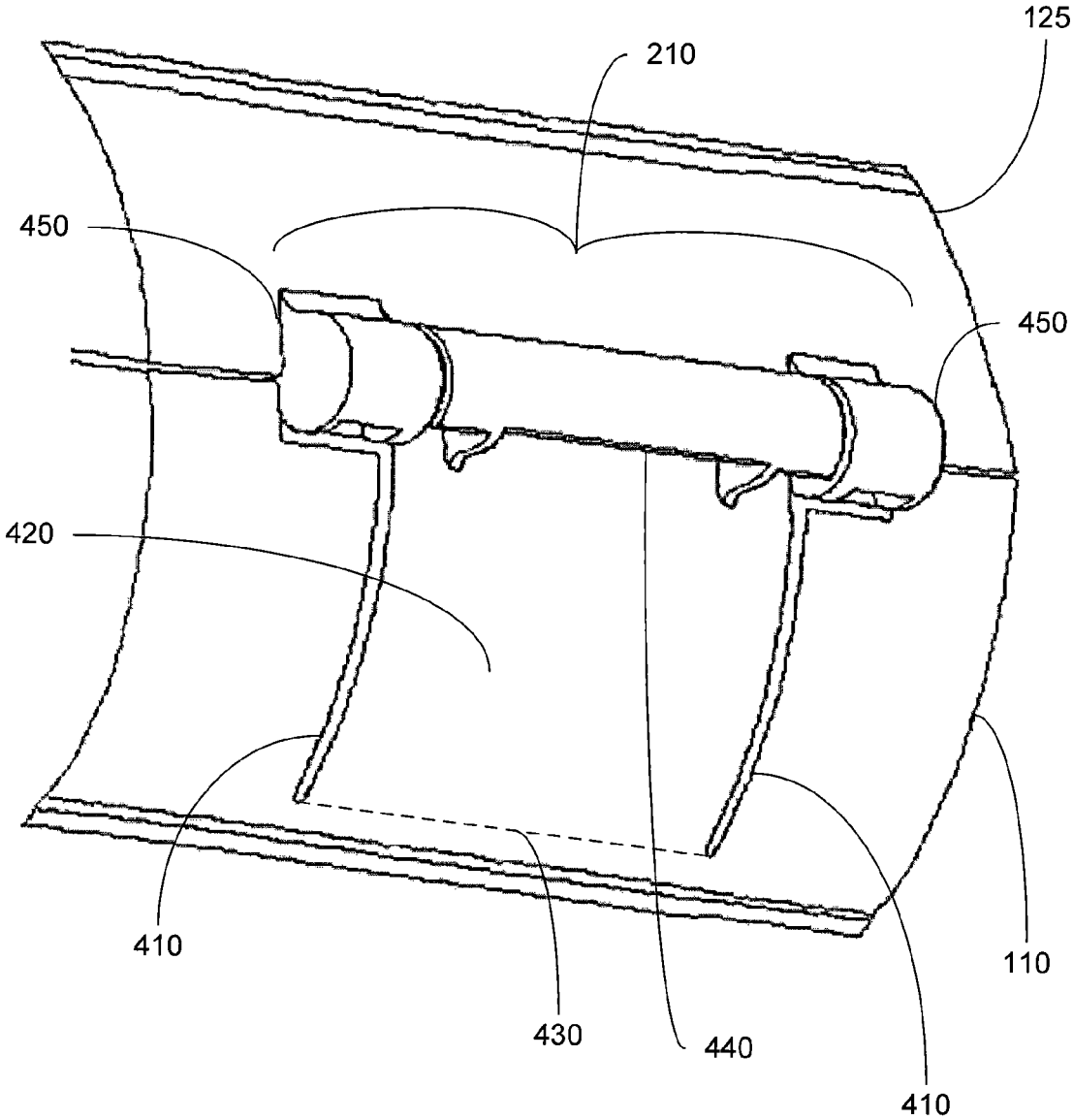
FIG. 4 is a close-up view of the hinge shown in FIG. 1.
Figure 4:
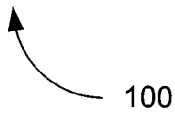

In FIG. 4, a close-up view of the hinge 210 is shown. In this embodiment, the hinge 210 is shown coupled with the chassis 110 such that the hinge is laterally movable with respect to the chassis 110. Two slots 410 run down the chassis 110, leaving an intermediate member 420 coupled to the chassis at connection line 430 (shown in FIG. 4 as a dashed line, this line may not actually be visible in a construction of the embodiment). The top part of the intermediate member 420 is connected with the inner part 440 of the hinge 210. The outer part 450 of the hinge 210 is connected to the body 125 of the paper cover assembly 120. In this manner, as the connection line 430 flexes, the hinge 210 may move laterally with respect to the chassis 110. The flexibility of the connection line 430 may also be viewed as a secondary hinge, thus allowing the first hinge 210 to be rotatably movable with some fixed point on the chassis 110 (for example, the connection line 420). Alternatively, the hinge 210 could be viewed as merely connected to a flexible portion of the chassis 110, allowing the hinge 210 to be laterally movable.

Figure 5:
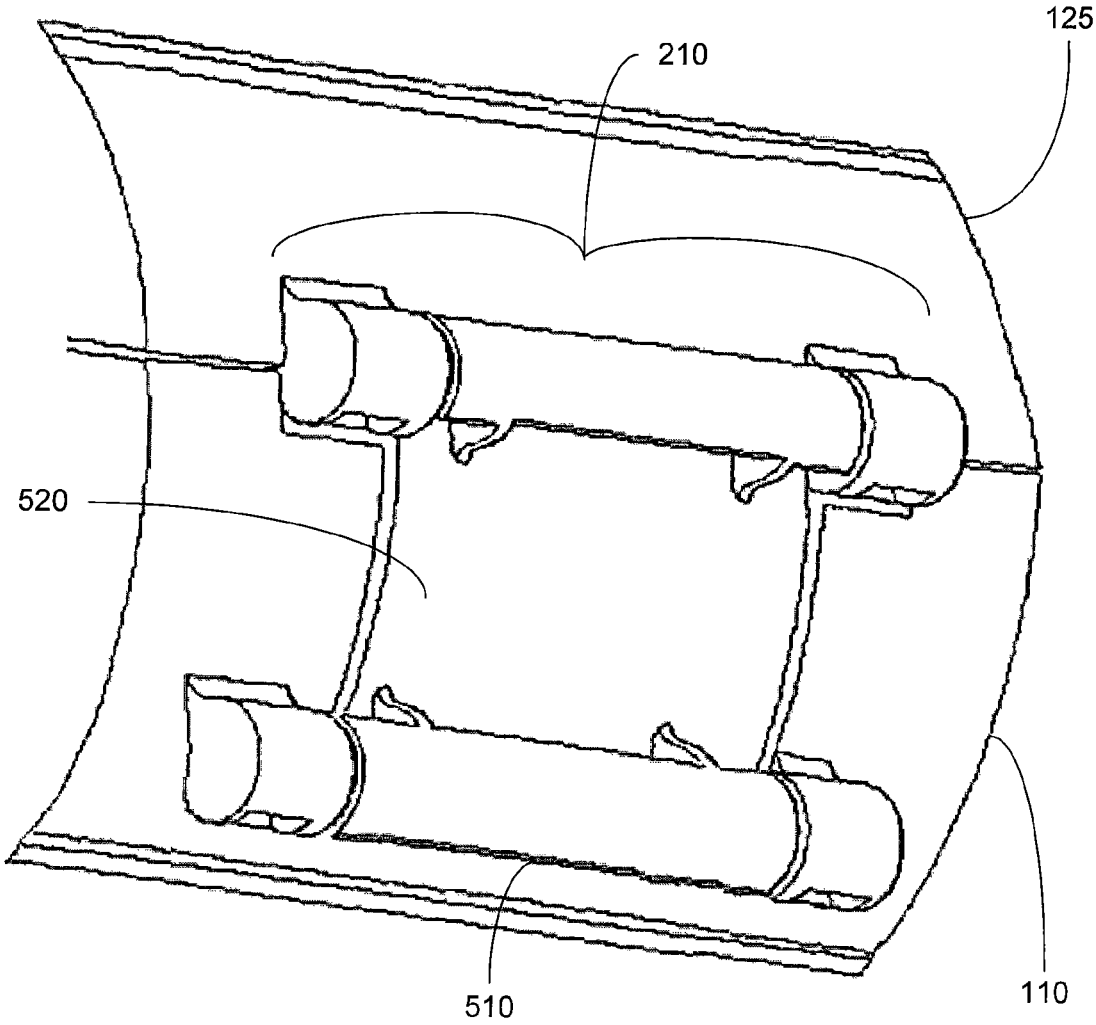
FIG. 5 is a close-up view of an alternative embodiment having a secondary hinge.
Figure 5:
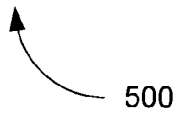

In FIG. 5, a close-up view of an embodiment with a secondary hinge 510 is shown. In this embodiment the body 125 of paper cover assembly 120 is coupled with the first hinge 210, the first hinge 210 is coupled with an intermediate member 520, the intermediate member 520 is coupled with the secondary hinge 510, and the secondary hinge 510 is coupled with the chassis 110. The first hinge 210 allows the paper cover assembly 125 to rotate with respect to the chassis 110, while the secondary hinge 510 allows the first hinge 210 to move laterally with respect to the chassis 110, and rotationally with respect to the secondary hinge 510. In some embodiments the hinges 210, 510 may be coupled directly to each other, without the intermediate member 520.

Figure 6:
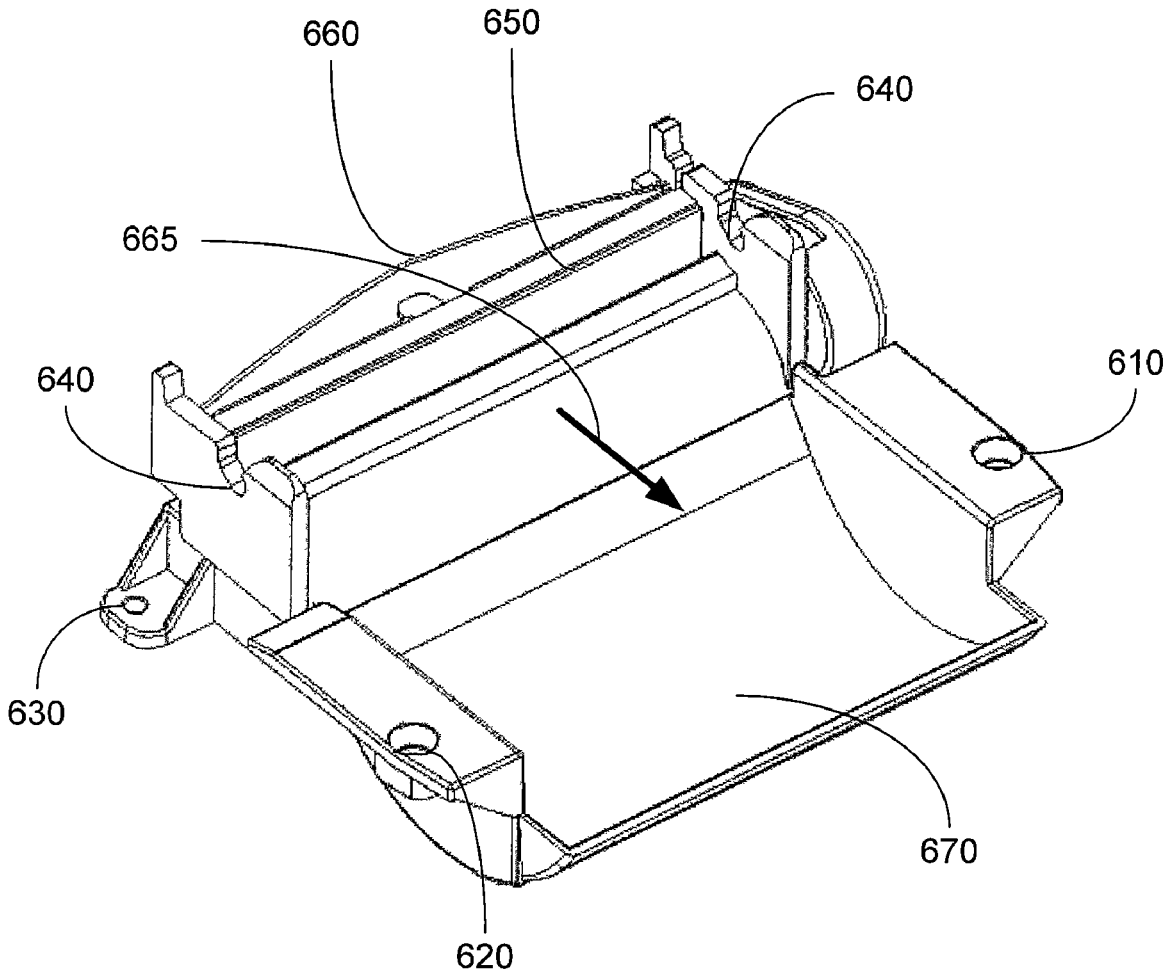
FIG. 6 is an isometric view of one chassis component which may make up at least a portion of the chassis shown in FIG. 1.
Figure 6:
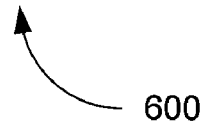

FIG. 6 is an isometric view of one component 600 which may make up at least a portion of the chassis 110 shown in the prior figures. The component 600 includes mounting holes 610, 620 and 630, which allow the component 600 to me coupled with other components of the chassis 110 in embodiments where the chassis 110 is made from multiple pieces. Notches 640 are defined by the component 600, and in some embodiments, the rotational axis of the roller 140 may be within the notches 640 when the paper cover assembly 120 is closed. The component 600 further includes a print head 650 and a trapezoidal spring 660 which may bias the print head 650 in the direction of the bias arrow 665. In some embodiments, the print head 650 may be biased in a direction so that it resists movement of the rotational axis of the roller 140 into or out of the notches 140. This direction may be that shown by the bias arrow 665. FIG. 6 also shows a rounded tray 670 which may be the part of the chassis 110 that holds a roll of paper.

Referring now to FIG. 1, FIG. 2, FIG. 4 and FIG. 6 it can now be appreciated that when the paper cover assembly 120 is closed, the rotational axis of the shaft 150 of the roller 140 may be within the notches 640 of the chassis 110, or a component 600 thereof. In the embodiment shown in FIG. 1, where the paper cover assembly 120 includes a handle 130 and a cam mechanism composed of a cam shaft 170 and cam heads 160, the cam heads 160 act laterally against the chassis 110 when the handle 130 is moved. By acting against the chassis 110, the cam heads 160 cause the remainder of the paper cover assembly 120 to laterally move with respect to the chassis 110. The paper cover assembly 120 may laterally move with respect to the chassis because the hinge 210 connecting the paper cover assembly 120 with the chassis 110 is laterally movable with respect to the chassis 110. As the paper cover assembly 120 moves, the rotational axis of the roller 140 and roller shaft 150, which may be substantially stationary with respect to the paper cover assembly 120, moves out of the notches 640 in the chassis 110, or a component 600 thereof. This may result in the paper cover assembly 120 opening.

In an embodiment with an additional secondary hinge 510 (as shown in FIG. 5), the cam heads 160 acting against the chassis 110 may cause the secondary hinge 510 to rotate, thereby moving the first hinge 210. This movement may cause the paper cover assembly 120 to move. Consequently the roller 140 and roller shaft 150 to move out of the notch 640, opening the paper cover assembly 120. In various embodiments, including those with only a first hinge 210, and those with an additional secondary hinge 510, the paper cover assembly 120 may be opened by a user applying a force (such as by pressing with a finger), on the outer side of the first hinge 210. This force may move the first hinge 210, and consequently the paper cover assembly 120, in the same direction as if a handle 130 and cam mechanism had been used to create a similar force. In such an embodiment, movement of the paper cover assembly 120 is allowed because the hinge 210 may move, thereby causing the rotational axis of the roller 140 and the roller shaft 150 to move out of the notches 640 in the chassis. This may result in the paper cover assembly 120 opening.

Figure 7:
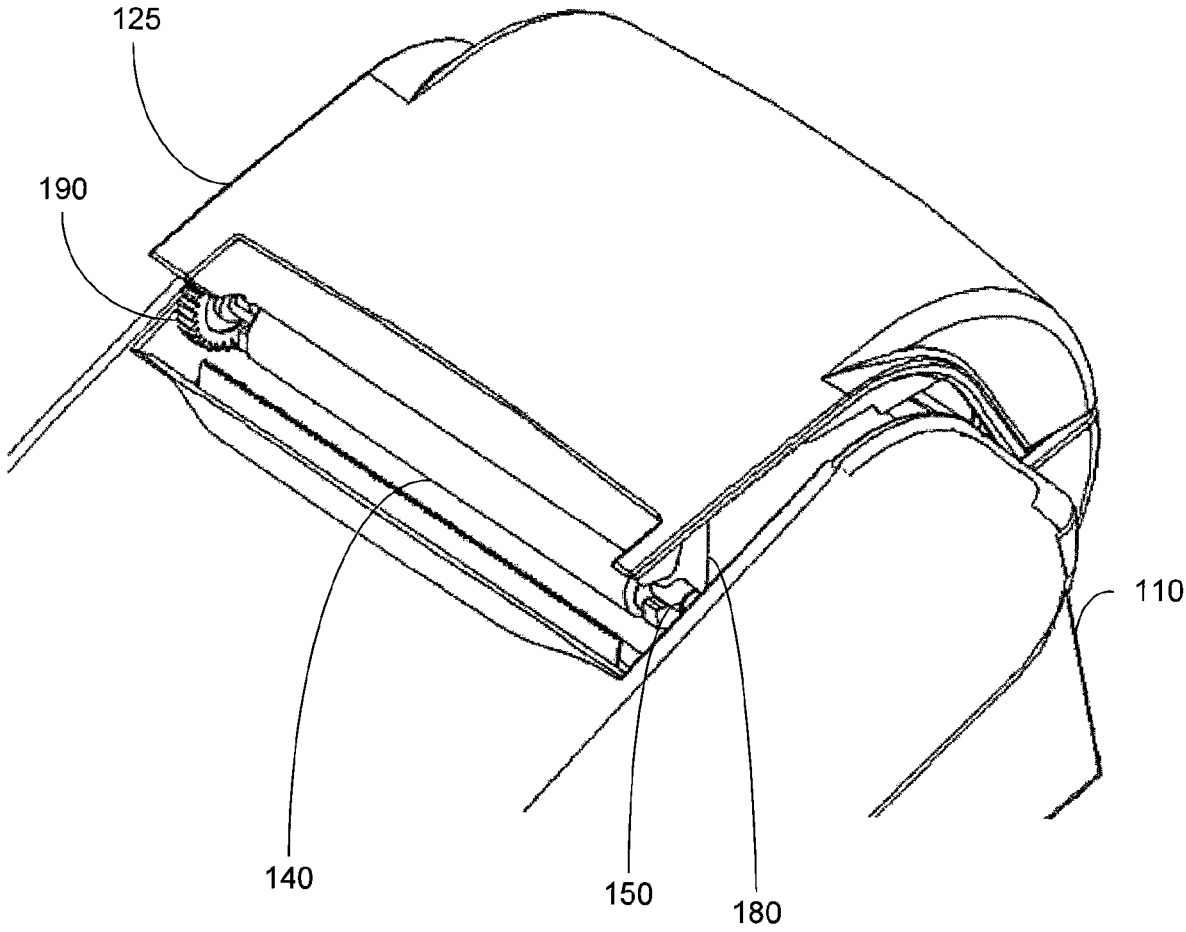
FIG. 7 is a partial isometric view of another embodiment of the present invention having a chassis, a hinge, and a paper cover, but not having a handle and cam mechanism.

In another embodiment, the printer may have a paper cover including merely the paper cover body 125, while omitting the handle 130, cam mechanism, and in some embodiments, the roller 140. A partial isometric view of such an embodiment is shown in FIG. 7. In these embodiments, the hinge 210 may couple the paper cover body 125 with the chassis 110, and the hinge 210 may be laterally movable with respect to the chassis 110. As detailed above, the user might apply a force to the outer side of the hinge 210 to move the hinge 210, and consequently the paper cover body 125, with respect to the chassis 110. This may cause the paper cover body 125 to open. In FIG. 7, the printer 700 is comprised of a chassis 110, a paper cover body 125, a roller 140, a roller shaft 150, roller shaft arms 180 (only one is completely visible in FIG. 7), a driver gear 190, and a hinge 210 (hidden from view, but similar to that shown in FIG. 2). When the user exerts a force on the hinge 210, the hinge 210 laterally moves with respect to the chassis 110, and consequently moves the paper cover body 125, the roller 140 and the roller shaft 150. If in this embodiment the rotational axis of the roller shaft 150 is in the notches 640 of the chassis 110 when the paper cover body 125 is closed, the movement of the roller shaft 150 resultant from the user force will move the roller shaft 150 from the notches 640 and open the paper cover body 125. In these and other embodiments, the chassis 110 may also include a print head 650 that is biased by a spring 660 which exerts a force in a direction that resists the movement of the roller 140, and consequently movement of the roller shaft 150 into and out of the notches 640 in the chassis 110.

The invention has now been described in detail for the purposes of clarity and understanding. However, those skilled in the art will appreciate that certain changes and modifications may be practiced within the scope of the appended claims.

What is claimed is:

1. A printer comprising:

a chassis including a printing head and at least one notch;

a hinge having a rotational axis, wherein the hinge is coupled with the chassis such that the rotational axis of the hinge is laterally movable with respect to the chassis; and a paper cover assembly coupled with the hinge, wherein the paper cover assembly is rotatable about the rotational axis of the hinge, and wherein the paper cover assembly includes:

a roller having a rotational axis, wherein when the paper cover assembly is closed, the rotational axis of the roller is within the notch; and a handle configured to move a cam mechanism, wherein when the paper cover assembly is closed and the cam mechanism is moved, the cam mechanism acts against the chassis causing the rotational axis of the hinge to laterally move with respect to the chassis, thereby causing the rotational axis of the roller to move out of the notch.

2. The printer of claim 1, wherein the chassis is substantially made from Acrylonitrile Butadiene Styrene.

3. The printer of claim 1, wherein the hinge being coupled with the chassis comprises the hinge coupled with an intermediate member flexibly coupled with the chassis.

4. The printer of claim 1, wherein the hinge being coupled with the chassis comprises the hinge coupled with a secondary hinge, wherein the secondary hinge is coupled with the chassis.

5. The printer of claim 1, wherein the hinge is configured such that applying a lateral force to the hinge when the paper cover assembly is closed moves the rotational axis of the hinge laterally with respect to the chassis, thereby causing the rotational axis of the roller to move out of the notch.

6. The printer of claim 1, wherein the rotational axis of the hinge is rotationally movable around a fixed point on the chassis.

7. The printer of claim 1, wherein the paper cover assembly further includes a spring configured to bias the position of the handle such that in the biased position the cam mechanism does not act against the chassis when the paper cover assembly is closed.

8. The printer of claim 1, wherein the rotational axis of the roller is substantially stationary with respect to the paper cover assembly.

9. The printer of claim 1, wherein the handle includes a raised portion configured to allow a user to pull the handle with a finger.

10. The printer of claim 1, wherein the cam mechanism includes a shaft and at least one cam head, wherein the handle is coupled to the shaft and the shaft is coupled with the cam head, and wherein the handle being configured to move the cam mechanism comprises the handle being configured to move the shaft.

11. The printer of claim 10, wherein the cam head is substantially made from Polyoxymethylene.

12. The printer of claim 1, further comprising a spring configured to bias the position of the printing head such that in the biased position the printing head resists the movement of the rotational axis of the roller into or out of the notch.

13. A printing system comprising:

a means for holding a source of paper; and a means for covering the source of paper;

a means for rotating the means for covering the source of paper relative to the means for holding the roll of paper, wherein the means for rotating the means for covering the source of paper relative to the means for holding the roll of paper has a rotational axis;

a means for allowing the rotational axis to laterally move, wherein when the rotational axis laterally moves, the means for covering the source of paper is at least partially opened; and means for moving the rotational axis, wherein the means for moving the rotational axis comprises a handle configured to move a cam mechanism, wherein when the means for covering the source of paper is closed and the cam mechanism is moved, the cam mechanism acts against the means for holding the source of paper causing the rotational axis to move laterally with respect to the means for holding the source of paper, thereby at least partially opening the means for covering the source of paper.

* * * * *